US009525236B2

(12) United States Patent
Lee

(10) Patent No.: US 9,525,236 B2
(45) Date of Patent: Dec. 20, 2016

(54) WATERPROOF CONNECTOR WITH GLUING PLANE COATED BY WATERPROOF GLUE

(71) Applicant: SIMULA TECHNOLOGY INC., Taoyuan (TW)

(72) Inventor: Yi-Ming Lee, Taoyuan (TW)

(73) Assignee: SIMULA TECHNOLOGY INC. (TW)

( * ) Notice: Subject to any disclaimer, the term of this patent is extended or adjusted under 35 U.S.C. 154(b) by 0 days.

(21) Appl. No.: 14/625,919

(22) Filed: Feb. 19, 2015

(65) Prior Publication Data

US 2016/0164217 A1 Jun. 9, 2016

(30) Foreign Application Priority Data

Dec. 5, 2014 (TW) ..... 103221564 U

(51) Int. Cl.

| | |
|---|---|
| ***H01R 13/40*** | (2006.01) |
| ***H01R 13/52*** | (2006.01) |
| ***H01R 24/60*** | (2011.01) |
| ***H01R 43/02*** | (2006.01) |
| ***H01R 13/6581*** | (2011.01) |
| *H01R 107/00* | (2006.01) |
| *H01R 33/965* | (2006.01) |

(52) U.S. Cl.

CPC ..... *H01R 13/5202* (2013.01); *H01R 13/5216* (2013.01); *H01R 13/6581* (2013.01); *H01R 24/60* (2013.01); *H01R 43/0221* (2013.01); *H01R 33/965* (2013.01); *H01R 2107/00* (2013.01)

(58) Field of Classification Search

CPC ..... H01R 13/5202; H01R 13/5219; H01R 13/5221; H01R 13/965

USPC ..... 439/271–277, 587, 660, 607.4

See application file for complete search history.

(56) References Cited

U.S. PATENT DOCUMENTS

| | | | | |
|---|---|---|---|---|
| 7,390,220 | B1 * | 6/2008 | Wu | H01R 9/03 439/607.06 |
| 7,972,151 | B2 * | 7/2011 | He | H01R 13/6471 439/108 |
| 8,882,515 | B2 * | 11/2014 | Lv | H01R 13/6581 439/607.35 |
| 2006/0240710 | A1 * | 10/2006 | Kato | H01R 13/5205 439/587 |
| 2010/0210124 | A1 * | 8/2010 | Li | H01R 23/6873 439/108 |

(Continued)

*Primary Examiner* — Tho D Ta
*Assistant Examiner* — Thang Nguyen
(74) *Attorney, Agent, or Firm* — Bacon & Thomas, PLLC

(57) ABSTRACT

The present invention is to provide a waterproof connector with a gluing plane coated by waterproof glue, which includes an isolation base having a gluing plane formed at a rear end thereof, a plurality of first and second connection terminals each having a rear end exposed out of the gluing plane and an isolation sheet positioned between the first and second connection terminals; a metal casing for allowing the gluing plane to be positioned therein near a back opening thereof while the isolation base is inserted into the metal casing via the back opening; and a waterproof glue layer formed by coating a waterproof glue along where the gluing plane and an inner surface of the metal casing are abutted with each other. Thus, when the waterproof glue is hardened to form the waterproof glue layer, cracks between the metal casing and the isolation base are fully and watertightly filled.

12 Claims, 5 Drawing Sheets

(56) References Cited

U.S. PATENT DOCUMENTS

| | | | | |
|---|---|---|---|---|
| 2011/0294327 | A1* | 12/2011 | Cocquyt | H01R 13/521<br>439/271 |
| 2013/0183845 | A1* | 7/2013 | Tan | H01R 13/5202<br>439/271 |
| 2014/0106594 | A1* | 4/2014 | Skvoretz | H01R 13/74<br>439/345 |
| 2015/0083498 | A1* | 3/2015 | Doherty | H01R 13/5219<br>175/57 |
| 2015/0255905 | A1* | 9/2015 | Little | H01R 13/6658<br>439/78 |

* cited by examiner

WATERPROOF CONNECTOR WITH GLUING PLANE COATED BY WATERPROOF GLUE

FIELD OF THE INVENTION

The present invention relates to a connector, more particularly to a waterproof connector with a gluing plane coated by waterproof glue, so as to ensure that outside moisture cannot enter into an electronic device through the connector.

BACKGROUND OF THE INVENTION

With improvements of the communication technology and the electronic technology, the electronic devices equipped with various functions, such as cell phones allowing worldwide people to communicate with each other, Walkman allowing people to listen music anytime and anywhere, personal computers assisting people to process many things, etc., have become necessary tools for modern persons. In addition, a variety of electronic devices can be combined integratedly, so the functions of using cell phone to listen music or using the personal computer to dial are implemented gradually.

The electronic devices are provided with thousands and thousands of precise electric devices, so during usage the electronic device must be protected from being short circuit due to contacting with water, or being damaged by affected with damp. Connection ports on the electronic device for connecting external devices are portions which are penetrated by moisture most easily. Some manufacturers mount a waterproof stopper on the connector or mount a waterproof washer inside the connector to stop penetration of moisture, however, usage of the waterproof stopper or the waterproof washer has problems of difficult assembly, too high cost, and being hardly applied to the connector with special standard. Please refer to FIG. 1 which shows a metal casing 11 of a connector compatible to the Micro USB standard. In order to keep the drawing simple, some elements such as a tongue plate and connection terminals inside the metal casing are not shown in the FIG. 1. The Micro USB connector is mainly adapted for a slim type electronic device, such as smart phone, a tablet computer, etc. In order to ensure the external plug 12 to steady transmit data during being inserted into a connector, the metal casing 11 is provided with two openings 110, and the external plug is provided with two hooks 121 correspondingly. When the external plug 12 is inserted into the Micro USB connector, the hooks 121 can hook the openings 110 to ensure the connection stability.

The openings 110 can ensure the connection strength of the Micro USB connector, but also generate a loophole for whole waterproof scheme. Therefore, if the manufacturer designs the Micro USB connector with the waterproof function, a metal plate must be soldered on a top surface of the metal casing 11 and a waterproof washer must be further mounted inside the metal casing 11 for ensuring the completeness of waterproof function. However, such design seriously impairs production and assembly speed of the connector, and efficiently improves manufacturing cost, so it is not an ideal design. Therefore, what is needed is to develop a new structure of waterproof connector which does not need waterproof stopper or waterproof washer and can be applied to the slim type special connector, so as to solve problems that the traditional connector has too high manufacturing cost and is not easy to be assembled.

SUMMARY OF THE INVENTION

In order to solve the problems that the traditional waterproof connector using waterproof stopper or waterproof washer has too high manufacturing cost and too low assembly efficiency, the inventor designs a waterproof connector with a gluing plane coated by waterproof glue based on long-term practice experience and repeated research and tests.

An objective of the present disclosure is to provide a waterproof connector with a gluing plane coated by waterproof glue. The waterproof connector includes an isolation base, a metal casing and a waterproof glue layer. The isolation base is made of plastic and provided with a plurality of first connection terminals, a plurality of second connection terminals and an isolation sheet fixedly disposed therein, and provided with a gluing plane formed at rear end thereof. Portions of the first connection terminals near ends thereof are exposed out of a top surface of the isolation base, and other ends of the plurality of first connection terminals are extended from the gluing plane and exposed out of the gluing plane. Portions of the plurality of second connection terminals near ends thereof are exposed out of a bottom surface of the isolation base, and other ends of the plurality of second connection terminals are extended from the gluing plane and exposed out of the gluing plane, and the isolation sheet is positioned between the plurality of first connection terminals and the plurality of second connection terminals. The metal casing is provided with a front opening at a front end thereof and a back opening at a rear end thereof, and the front opening and the back opening are communicated with each other to form an accommodating space inside the metal casing. The gluing plane is positioned inside the metal casing and near the back opening in a condition of the isolation base being inserted into the accommodating space via the back opening. The waterproof glue layer is formed by coating the waterproof glue along where the gluing plane and an inner surface of the metal casing are abutted with each other, and the waterproof glue is then hardened to form the waterproof glue layer to watertightly filled cracks between the metal casing and the isolation base fully. Therefore, a waterproof scheme can be implemented without using the waterproof washer or the waterproof stopper, and the outside moisture cannot penetrate via cracks between the metal casing and the isolation base, and a life time of an electronic device can be efficiently ensured.

Another objective of the present disclosure is that the isolation base further includes a shield block fixedly disposed near rear ends of the connection terminals by injection molding. The shield block is spaced apart from the gluing plane by an interval, the shield block is further provided with a slot passed therethrough, and the slot is communicated with the interval. When the isolation base is inserted into the metal casing, the shield block can be abutted against an edge of the metal casing corresponding to the back opening. Therefore, the manufacturer can infuse the waterproof glue with lower viscosity into the slot, whereby the waterproof glue can be fully filled to form the waterproof glue layer.

BRIEF DESCRIPTION OF THE DRAWINGS

The detailed structure, operating principle and effects of the present disclosure will now be described in more details hereinafter with reference to the accompanying drawings that show various embodiments of the present disclosure as follows.

DETAILED DESCRIPTION OF THE PREFERRED EMBODIMENTS

Figure 1:
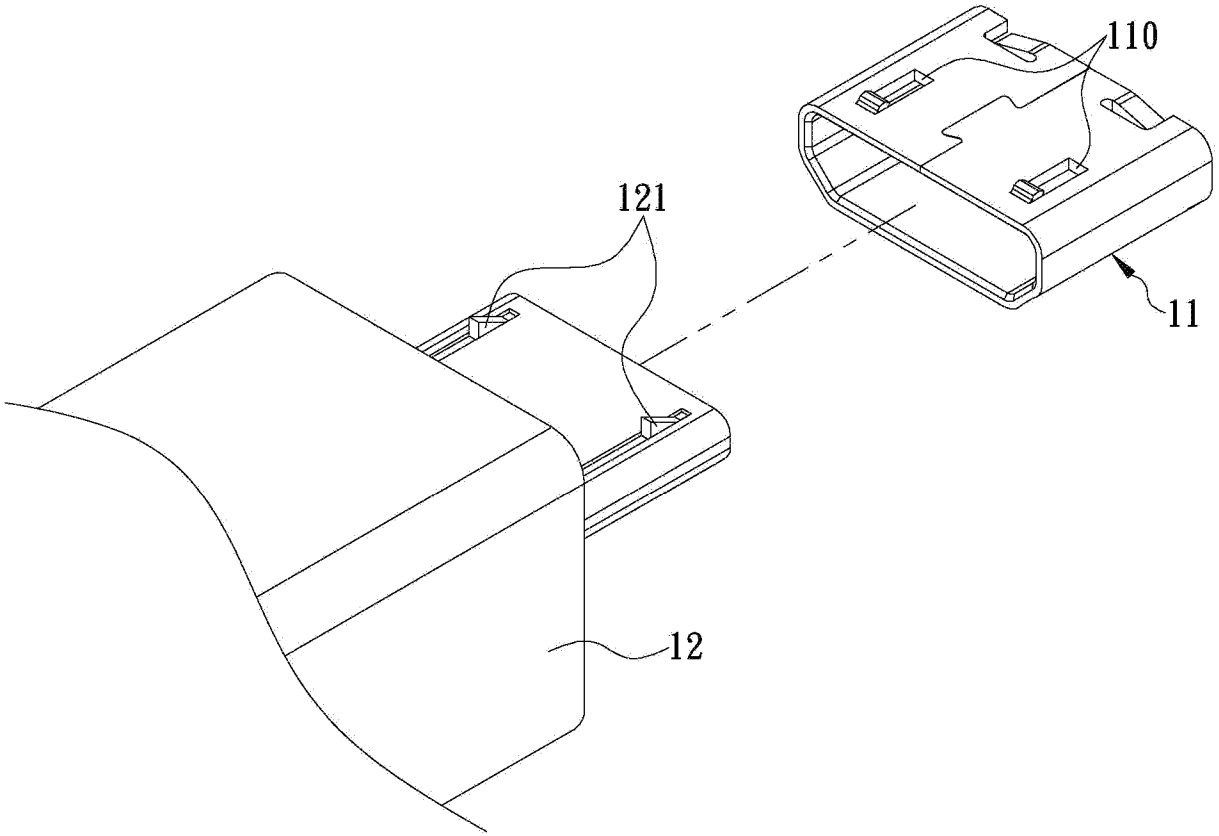
FIG. 1(Prior Art)
FIG. 1 is a schematic view of a metal casing of a traditional Micro USB connector.

Reference will now be made in detail to the exemplary embodiments of the present disclosure, examples of which are illustrated in the accompanying drawings. Therefore, it is to be understood that the foregoing is illustrative of exemplary embodiments and is not to be construed as limited to the specific embodiments disclosed, and that modifications to the disclosed exemplary embodiments, as well as other exemplary embodiments, are intended to be included within the scope of the appended claims. These embodiments are provided so that this disclosure will be thorough and complete, and will fully convey the inventive concept to those skilled in the art. The relative proportions and ratios of elements in the drawings may be exaggerated or diminished in size for the sake of clarity and convenience in the drawings, and such arbitrary proportions are only illustrative and not limiting in any way. The same reference numbers are used in the drawings and the description to refer to the same or like parts.

It will be understood that, although the terms 'first', 'second', 'third', etc., may be used herein to describe various elements, these elements should not be limited by these terms. The terms are used only for the purpose of distinguishing one component from another component. Thus, a first element discussed below could be termed a second element without departing from the teachings of embodiments. As used herein, the term "or" includes any and all combinations of one or more of the associated listed items.

The present disclosure illustrates a waterproof connector with a gluing plane coated by waterproof glue. Please refer to FIG. 2 and FIG. 3 which show a first preferred embodiment of the present disclosure. The waterproof connector 2 includes an isolation base 21, a metal casing 22 and a waterproof glue layer 23. The isolation base 21 is made of plastic by injection molding, and is provided with a plurality of first connection terminals 211, a plurality of second connection terminals 212 and an isolation sheet 213 fixedly disposed inside. The connection terminals 211 and 212 match with the Micro USB standard, so that the waterproof connector 2 can be used as a high speed transmission connector compatible to USB 3.1 Type-C standard. The isolation sheet 213 is a metal sheet and positioned between the connection terminals 211 and 212 in order to isolate signal interference between the connection terminals 211 and 212.

The isolation base 21 is provided with a gluing plane 210 formed near a rear end thereof, and a part of each first connection terminal 211 near an end is exposed out of a top surface of the isolation base 21, and other end of each first connection terminal 211 is extended from the gluing plane 210 and exposed out of the gluing plane 210. A portion of each second connection terminal 212 near an end is exposed out of a bottom surface of the isolation base 21, and other end of each second connection terminal 212 is extended from the gluing plane 210 and exposed out of the gluing plane 210. The other ends of the connection terminals 211 and 212 can be soldered on a circuit board respectively.

Figure 4:
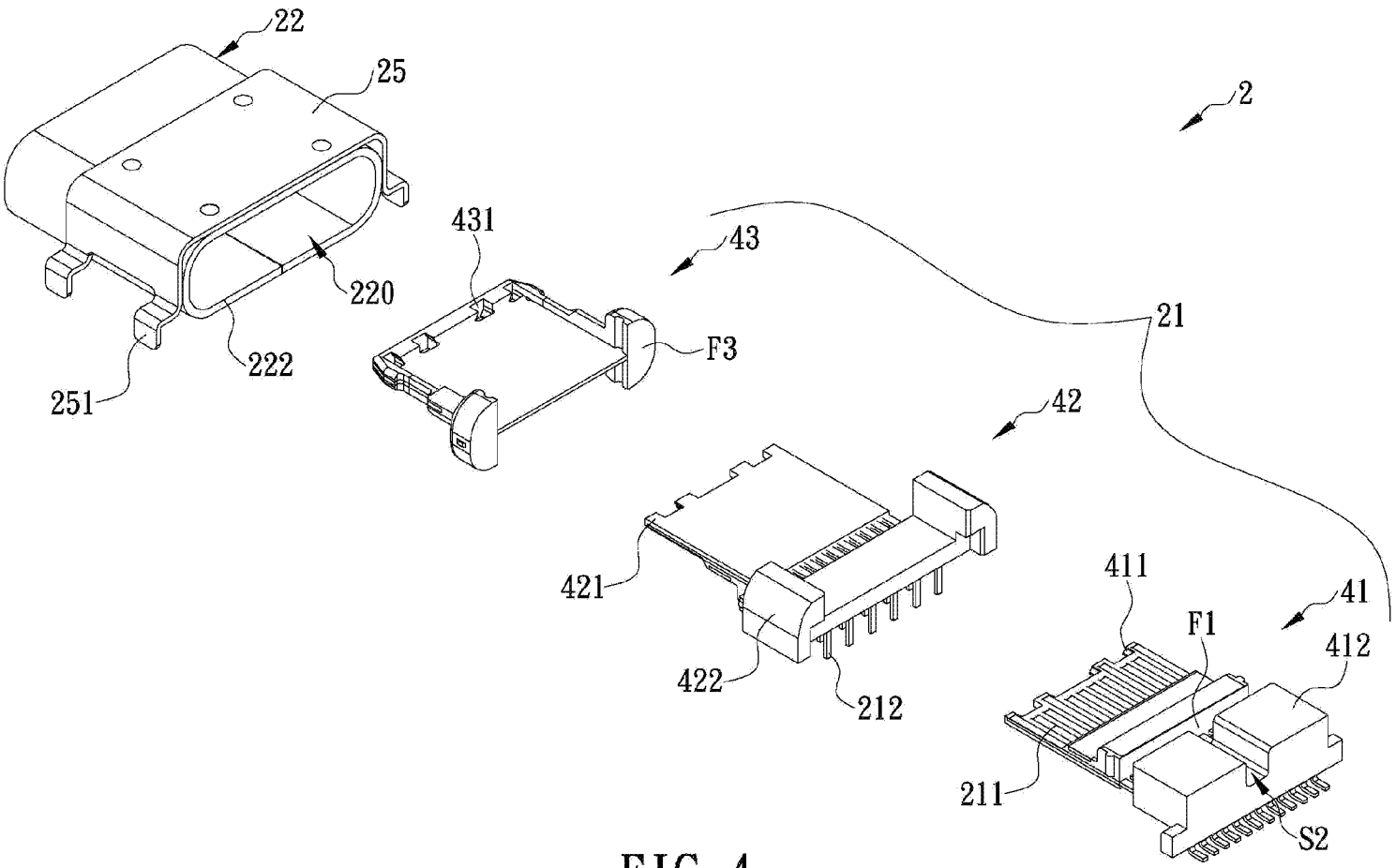
FIG. 4 is an exploded view of the waterproof connector of the present disclosure.

The metal casing 22 is provided with a front opening 221 at a front end thereof and the back opening 222 at a rear end thereof, and the front opening 221 and the back opening 222 are communicated with each other to form an accommodating space 220 inside the metal casing 22. In this exemplary embodiment, the metal casing 22 is made by connecting a bent metal sheet by laser spot welding. As shown in FIG. 4, the metal casing 22 is formed integratedly by the laser spot welding a seam on the metal casing 22, so the metal casing 22 has no joint on a periphery thereof except for the front opening 221 and the back opening 222. The manufacturers need not mount a waterproof sealant over the metal casing 22 to ensure watertightness of the metal casing 22. In a condition that the isolation base 21 is inserted into the accommodating space 220 via the back opening 222, the gluing plane 210 is positioned inside the metal casing 22 and near the back opening 222, as a status shown in FIG. 2.

Please refer back to FIG. 2 and FIG. 3. the waterproof glue layer 23 is formed by coating the waterproof glue at portions where the gluing plane 210 and an inner surface of the metal casing 22 are abutted with each other, so that the waterproof glue layer 23 is formed after the waterproof glue is hardened, the waterproof glue layer 23 can be watertightly filled the cracks between the metal casing 22 and the isolation base 21 fully. Therefore, after the waterproof connector 2 is mounted on an electronic device, even outside moisture is penetrated into the accommodating space 220 via the front opening 221, the moisture is also isolated by the isolation base 21 and the waterproof glue layer 23 and prevented from contacting with the circuit board inside the electronic device via the back opening 222, so as to efficiently ensure a life time of the electronic device.

Please refer back to FIG. 2 and FIG. 3. In a second preferred embodiment of the present disclosure, the isolation base 21 further includes a shielding block 214 which is fixedly disposed on the connection terminals 211 and 212 and near the rear ends of the connection terminals 211 and 212. The isolation base 21 is spaced apart from the gluing plane 210 by an interval S1, and provided with a slot S2 passed therethrough. The slot S2 is communicated with the interval S1. When the isolation base 21 is inserted into the metal casing 22, the shield block 214 can be abutted against an edge of metal casing 22 corresponding to the back opening 222.

Therefore, most of area of the back opening 222 is shielded by the shield block 214, but the manufacturer can infuse the waterproof glue with lower viscosity into the interval S1, to make the waterproof glue fill portions where the gluing plane 210 and the inner surface of the metal casing 22 are abutted with each other. After the waterproof glue is hardened, the waterproof glue can be watertightly filled the cracks between the metal casing 22 and the isolation base 21, so the manufacturer's gluing process or coating procedure can be simpler and executed more easily.

Figure 2:
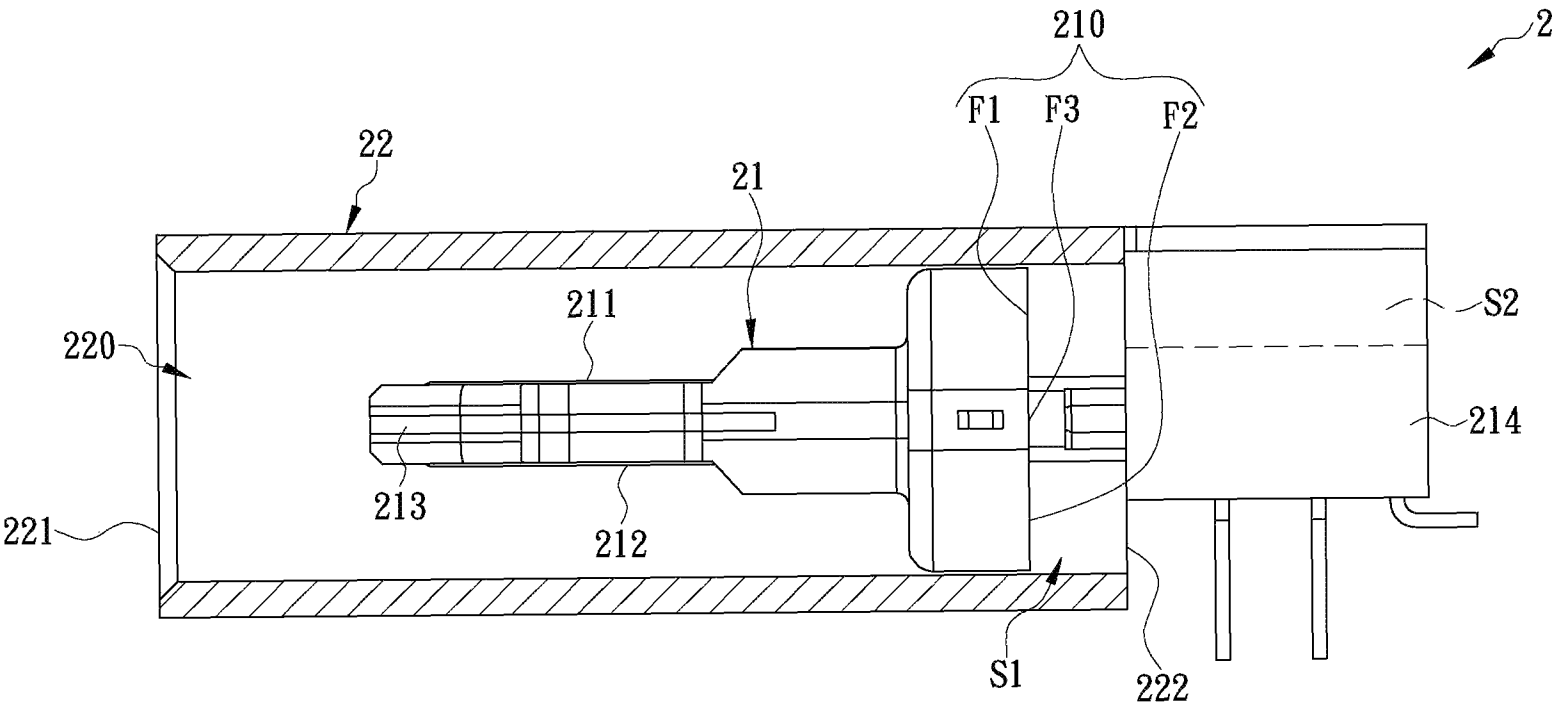
FIG. 2 is an assembly schematic view of a waterproof connector of the present disclosure.
Figure 3:
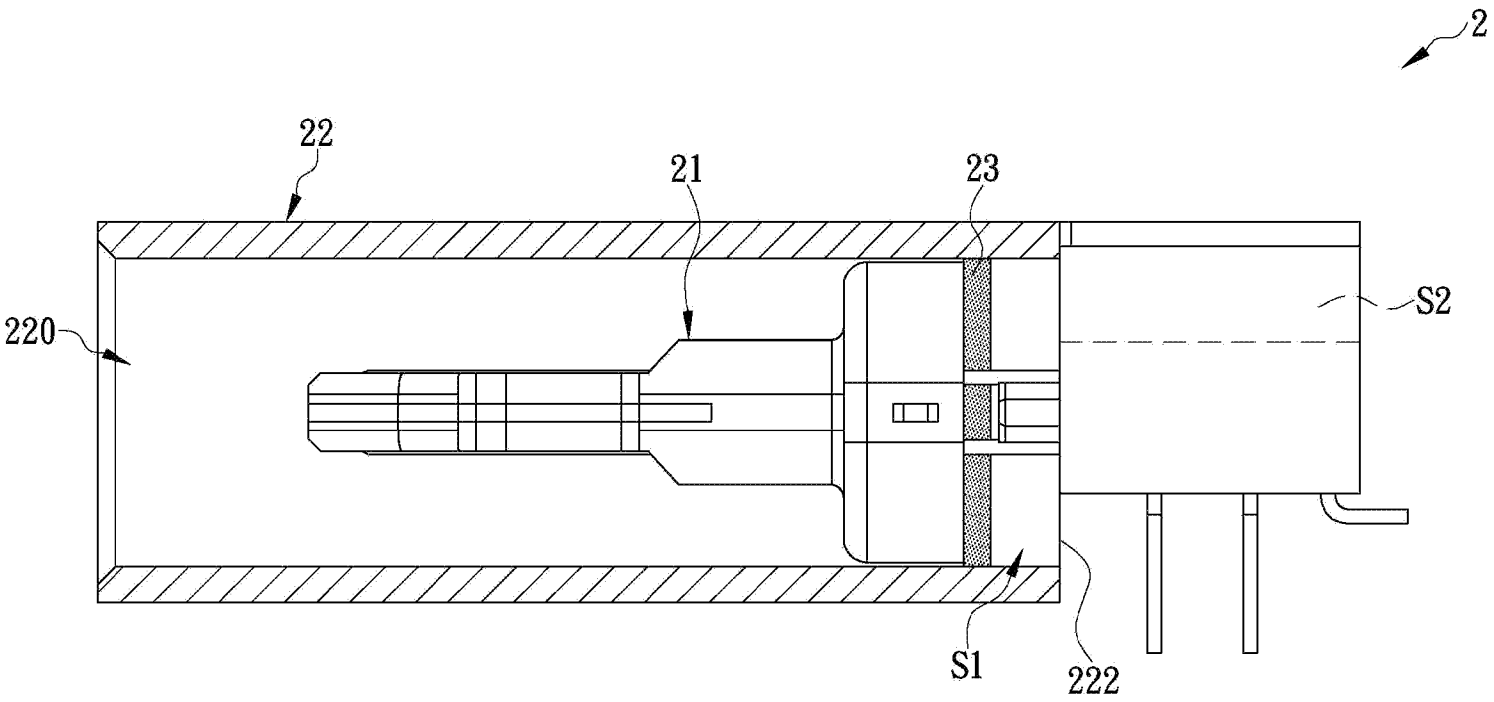
FIG. 3 is a schematic view of a waterproof glue layer of the waterproof connector of the present disclosure.

Please refer to FIG. 2 through FIG. 4. In other preferred embodiment of the present disclosure, the isolation base 21 is formed by a terminal block 41, a central base 43 and a second terminal block 42. The central base 43 is made of plastic integrally, and provided with the isolation sheet 213 fixedly disposed therein and a plurality of fastening slots 431 on front edges of a top side and a bottom side thereof respectively. The first terminal block 41 is made of plastic integrally, and provided with the first connection terminals 211 fixedly disposed therein. A portion of each first connection terminal 211 near an end thereof is exposed out of a top surface of the first terminal block 41, and each first connection terminal 211 is provided with a plurality of first fastening parts 411 at a front end thereof, and a first shielding part 412 at a rear end thereof, and the first shielding part 412 is provided with a slot S2.

The second terminal block 42 is made of plastic integrally, and provided with the second connection terminals 212 fixedly disposed therein. A portion of each second connection terminal 212 near an end thereof is exposed out of a bottom surface of the second terminal block 42. Each second connection terminal 211 is provided with a plurality of second fastening parts 421 at a front end thereof and a second shielding part 422 at a rear end thereof. When the first fastening parts 411 and the second fastening parts 421 are fastened in the fastening slots 431, the first terminal block 41, the central base 43 and the second terminal block 42 can be assembled to form the isolation base 21, and the gluing plane 210 is formed by a central section of the isolation base 21 which corresponds to the portions of the other ends of the connection terminals 211 and 212 exposed out, such as planes F1, F2 and F3 shown in FIG. 2 and FIG. 4. The first shielding part 412 and the second shielding part 422 can be assembled integratedly to form the shield block 214.

It particularly mentions that in above-mentioned embodiment a structure of a cross section of the metal casing 22 is in an elliptical shape with longitudinal symmetry, and the metal casing 22 is formed by bending a metal sheet and then sealing by laser spot welding. Therefore, except for the front opening 221 and the back opening 222, the metal casing 22 has no other opening or crack, and the metal casing 22 can have stronger structural strength and water-resistance. Accordingly, even if the connector which is adapted for Micro USB and advertised for slim type can also ensure durability and connection stability. In addition, the shield block 214 is not a necessary element of the present disclosure, and the manufacturer can also directly implement the waterproof scheme of the present disclosure by the gluing plane 210 at the rear end of the isolation base 21.

Figure 5:
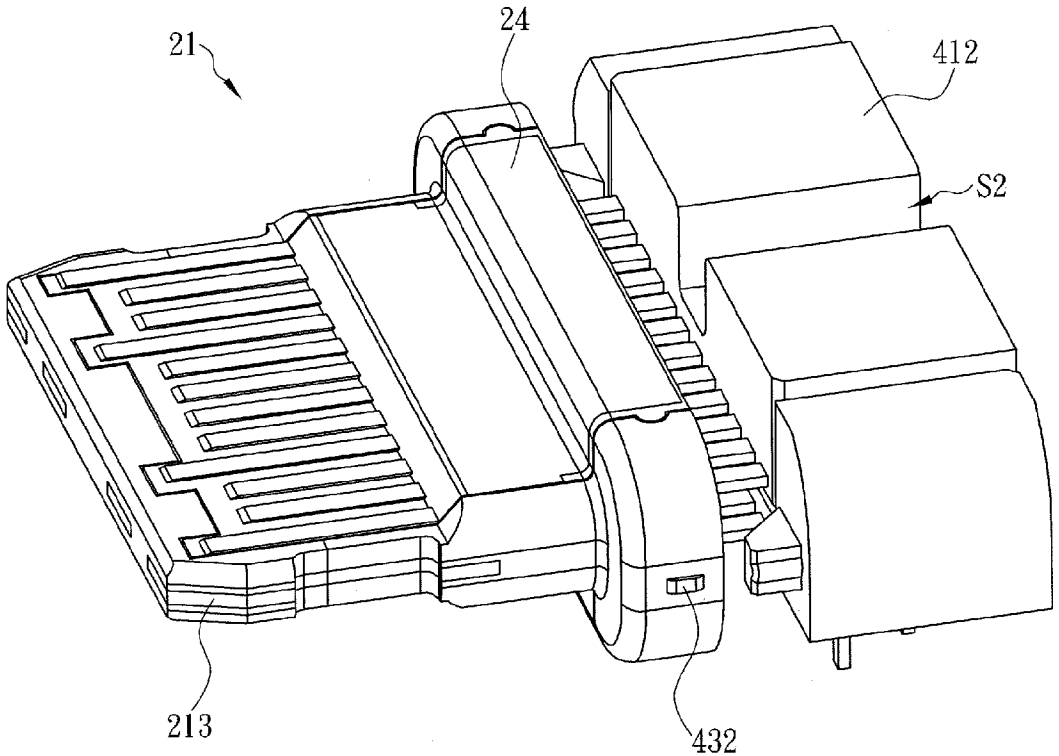
FIG. 5 is a schematic view of an isolation base of the waterproof connector of the present disclosure.

Please refer to FIG. 4 and FIG. 5 In a preferred embodiment of the present disclosure, the isolation sheet 213 is exposed out of a top surface and a bottom surface of the central base 43, and a front edge of the isolation sheet 213 is exposed out of a periphery of the front end of the central base 43, so as to increase a structural strength of the isolation base 21 for plugging. In addition, the waterproof connector 2 further includes two grounding plates 24 and a metal support 25, and each of the two grounding plates 24 is fixedly disposed at the top surface and the bottom surface of the isolation base 21, for example, the connection terminals 211 and 212 are formed on the terminal blocks 41 and 42 respectively by using injection molding process. When the isolation base 21 is inserted into the metal casing 22, the grounding plates 24 can be abutted against the inner surface of the metal casing 22 to achieve a grounding effect. The grounding plates 24 have the same structures, so only one grounding plate 24 is illustrated in the FIG. 5.

The metal support 25 has a structure matching with that of the metal casing 22, and is provided with pins 251 extended from the two corresponding ends thereof. The central portion of the metal support 25 can be fastened on the top surface of the metal casing 22 by the laser spot welding. In FIG. 4, the dots drawn on the metal casing 22 indicate spot welding positions. The pins 251 can be fastened on the circuit board.

The central base 43 is provided with a plurality of protruded parts 432 protrudingly disposed thereon. When the isolation base 21 is inserted into the metal casing 22, the protruded parts 432 can pack the inner surface of the metal casing 22 to enable the isolation base 21 and the metal casing 22 to be assembled integratedly.

The above-mentioned descriptions represent merely the exemplary embodiment of the present disclosure, without any intention to limit the scope of the present disclosure thereto. Various equivalent changes, alternations or modifications based on the claims of present disclosure are all consequently viewed as being embraced by the scope of the present disclosure.

What is claimed is:

1. A waterproof connector with a gluing plane coated by waterproof glue, comprising:

an isolation base made of plastic, provided with a plurality of first connection terminals, a plurality of second connection terminals and an isolation sheet fixedly disposed therein, provided with a shield block fixedly disposed near rear ends of the connection terminals by injection molding, and provided with a gluing plane formed at rear end thereof, wherein portions of the plurality of first connection terminals near end thereof are exposed out of a top surface of the isolation base, other ends of the plurality of first connection terminals are extended from the gluing plane and exposed out, portions of the plurality of second connection terminals near end thereof are exposed out of a bottom surface of the isolation base, other ends of the plurality of second connection terminals are extended from the gluing plane and exposed out, the isolation sheet is positioned between the plurality of first connection terminals and the plurality of second connection terminals, the shield block is spaced apart from the gluing plane by an interval, the shield block is further provided with a slot passed therethrough, and the slot is communicated with the interval;

a metal casing, provided with a front opening at a front end thereof and a back opening at a rear end thereof, wherein the front opening and the back opening are communicated with each other to form an accommodating space inside the metal casing, the gluing plane is positioned inside the metal casing and near the back opening while the isolation base is inserted into the accommodating space via the back opening and, when the isolation base is inserted into the metal casing, the shield block can be abutted against an edge of the metal casing corresponding to the back opening; and a waterproof glue layer, formed by coating the waterproof glue along where the gluing plane and an inner surface of the metal casing are abutted with each other, whereby, when the waterproof glue is hardened to form the waterproof glue layer, cracks between the metal casing and the isolation base are fully and watertightly filled by the waterproof glue layer.

2. The waterproof connector as defined in claim 1, wherein the isolation base further comprises:

a central base made of plastic integrally, provided with the isolation sheet fixedly disposed therein and a plurality of fastening slots respectively formed at front edges of a top side and a bottom side thereof;

a first terminal block made of plastic integrally, provided with the first connection terminals fixedly disposed therein, wherein a portion of each of the plurality of first connection terminals near an end thereof is exposed out of a top surface of the first terminal block, and each of the plurality of first connection terminal is provided with a plurality of first fastening parts at a front end thereof and a first shielding part at a rear end thereof; and a second terminal block made of plastic integrally, provided with the plurality of second connection terminals fixedly disposed therein, wherein a portion of each of the plurality of second connection terminals near an end thereof is exposed out of a bottom surface of the second terminal block, and each of the plurality of second connection terminals is provided with a plurality of second fastening parts at a front end thereof and a second shielding part at a rear end thereof;

whereby, when the plurality of first fastening parts and the plurality of second fastening parts are fastened in the fastening slots, the first terminal block, the central base and the second terminal block are assembled to form the isolation base, the gluing plane is formed by a central section of the isolation base 21 which corresponds to the exposed portions of the other ends of the connection terminals, and the first shielding part and the second shielding part can be assembled integratedly to form the shield block.

3. The waterproof connector according to claim 2, wherein the isolation sheet can be exposed out of a top surface and a bottom surface of the central base.

4. The waterproof connector as defined in claim 3, wherein the waterproof connector further comprises a metal support which has a structure matching with a structure of the metal casing and provided with pins respectively disposed at two corresponding ends thereof and downwardly extended, a central portion of the metal support is fastened at the top surface of the metal casing by the laser spot welding, and the pins can be fastened on a circuit board.

5. The waterproof connector as defined in claim 4, wherein the isolation base is provided with a plurality of protruded parts protrudingly disposed thereon, and when the isolation base is inserted into the metal casing, the protruded parts can be packed the inner surface of the metal casing, whereby the isolation base and the metal casing can be assembled integratedly.

6. The waterproof connector as defined in claim 5, wherein a cross section of the metal casing is in an elliptical shape with longitudinal symmetry.

7. A waterproof connector with a gluing plane coated by waterproof glue, comprising:

an isolation base made of plastic, provided with a plurality of first connection terminals, a plurality of second connection terminals and an isolation sheet fixedly disposed therein, provided with a shield block fixedly disposed near rear ends of the connection terminals by injection molding, and provided with a gluing plane formed at rear end thereof, wherein portions of the plurality of first connection terminals near end thereof are exposed out of a top surface of the isolation base, other ends of the plurality of first connection terminals are extended from the gluing plane and exposed out, portions of the plurality of second connection terminals near end thereof are exposed out of a bottom surface of the isolation base, other ends of the plurality of second connection terminals are extended from the gluing plane and exposed out, the isolation sheet is positioned between the plurality of first connection terminals and the plurality of second connection terminals, the shield block is spaced apart from the gluing plane by an interval, the shield block is further provided with a slot passed therethrough, and the slot is communicated with the interval;

a metal casing, formed by bending a metal sheet and then connecting two edges of the metal sheet by laser spot welding, and provided with a front opening at a front end thereof and a back opening at a rear end thereof, wherein the front opening and the back opening are communicated with each other to form an accommodating space inside the metal casing, the gluing plane is positioned inside the metal casing and near the back opening while the isolation base is inserted into the accommodating space via the back opening and, when the isolation base is inserted into the metal casing, the shield block can be abutted against an edge of the metal casing corresponding to the back opening; and a waterproof glue layer, formed by coating the waterproof glue along where the gluing plane and an inner surface of the metal casing are abutted with each other, whereby, when the waterproof glue is hardened to form the waterproof glue layer, cracks between the metal casing and the isolation base are fully and watertightly filled by the waterproof glue layer.

8. The waterproof connector as defined in claim 7, wherein the isolation base further comprises:

a central base made of plastic integrally, provided with the isolation sheet fixedly disposed therein and a plurality of fastening slots respectively formed at front edges of a top side and a bottom side thereof;

a first terminal block made of plastic integrally, provided with the first connection terminals fixedly disposed therein, wherein a portion of each of the plurality of first connection terminals near an end thereof is exposed out of a top surface of the first terminal block, and each of the plurality of first connection terminal is provided with a plurality of first fastening parts at a front end thereof and a first shielding part at a rear end thereof; and a second terminal block made of plastic integrally, provided with the plurality of second connection terminals fixedly disposed therein, wherein a portion of each of the plurality of second connection terminals near an end thereof is exposed out of a bottom surface of the second terminal block, and each of the plurality of second connection terminals is provided with a plurality of second fastening parts at a front end thereof and a second shielding part at a rear end thereof;

whereby, when the plurality of first fastening parts and the plurality of second fastening parts are fastened in the fastening slots, the first terminal block, the central base and the second terminal block are assembled to form the isolation base, the gluing plane is formed by a central section of the isolation base 21 which corresponds to the exposed portions of the other ends of the connection terminals, and the first shielding part and the second shielding part can be assembled integratedly to form the shield block.

9. The waterproof connector according to claim 8, wherein the isolation sheet can be exposed out of a top surface and a bottom surface of the central base.

10. The waterproof connector as defined in claim 9, wherein the waterproof connector further comprises a metal support which has a structure matching with a structure of the metal casing and provided with pins respectively disposed at two corresponding ends thereof and downwardly extended, a central portion of the metal support is fastened at the top surface of the metal casing by the laser spot welding, and the pins can be fastened on a circuit board.

11. The waterproof connector as defined in claim 10, wherein the isolation base is provided with a plurality of protruded parts protrudingly disposed thereon, and when the isolation base is inserted into the metal casing, the protruded parts can be packed the inner surface of the metal casing, whereby the isolation base and the metal casing can be assembled integratedly.

12. The waterproof connector as defined in claim 11, wherein a cross section of the metal casing is in an elliptical shape with longitudinal symmetry.

* * * * *